US009649234B2

(12) United States Patent
Kume et al.

(10) Patent No.: US 9,649,234 B2
(45) Date of Patent: May 16, 2017

(54) SEPARABLE BED

(71) Applicant: Panasonic Intellectual Property Management Co., Ltd., Osaka (JP)

(72) Inventors: Yohei Kume, Osaka (JP); Shohei Tsukada, Hyogo (JP); Hideo Kawakami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 226 days.

(21) Appl. No.: 14/442,230

(22) PCT Filed: Sep. 12, 2014

(86) PCT No.: PCT/JP2014/004739

§ 371 (c)(1),
(2) Date: May 12, 2015

(87) PCT Pub. No.: WO2015/040847

PCT Pub. Date: Mar. 26, 2015

(65) Prior Publication Data

US 2016/0287455 A1 Oct. 6, 2016

(30) Foreign Application Priority Data

Sep. 17, 2013 (JP) ..... 2013-191417

(51) Int. Cl.
*A61G 5/04* (2013.01)
*A61G 5/12* (2006.01)
(Continued)

(52) U.S. Cl.
CPC ..... *A61G 5/006* (2013.01); *A47K 3/282* (2013.01); *A61G 1/00* (2013.01); *A61G 7/012* (2013.01);
(Continued)

(58) Field of Classification Search
CPC . A61G 5/006; A61G 5/12; A61G 5/04; A61G 7/16; A61G 7/012; A61G 7/018
See application file for complete search history.

(56) References Cited

U.S. PATENT DOCUMENTS 4,240,169 A * 12/1980 Roos ..... A61G 3/06 297/DIG. 4
4,987,620 A * 1/1991 Sharon ..... A61G 5/006 5/600

(Continued)

FOREIGN PATENT DOCUMENTS

CN 201404386 2/2010
CN 101926715 12/2010

(Continued)

OTHER PUBLICATIONS

Office Action and Search Report issued Sep. 6, 2015 in Chinese Application No. 201480002803.9, with English translation.

(Continued)

*Primary Examiner* — David E Sosnowski
*Assistant Examiner* — Ifeolu Adeboyejo
(74) *Attorney, Agent, or Firm* — Wenderoth, Lind & Ponack, L.L.P.

(57) ABSTRACT

A separable bed includes a bed portion and a wheelchair portion that is combined with the bed portion to compose the separable bed. The wheelchair portion includes a second seat portion, and a second guide portion that supports the second seat portion, the bed portion includes a first bed bottom portion, a first guide portion that supports the second seat portion and the first bed bottom portion, a lifter that performs lifting operation of the first bed bottom portion, and a controller, and the controller lowers the first guide portion to a second lower limit position in a case where separation operation is performed.

18 Claims, 8 Drawing Sheets

(51) Int. Cl.

| | |
|---|---|
| ***A61G 5/00*** | (2006.01) |
| ***A61G 7/16*** | (2006.01) |
| ***A61G 7/012*** | (2006.01) |
| ***A47K 3/28*** | (2006.01) |
| ***A61G 1/00*** | (2006.01) |
| ***A61G 7/015*** | (2006.01) |
| ***A61G 7/018*** | (2006.01) |

(52) U.S. Cl.
CPC ..... *A61G 7/015* (2013.01); *A61G 7/018* (2013.01); *A61G 7/16* (2013.01); *A61G 7/165* (2016.11)

(56) References Cited

U.S. PATENT DOCUMENTS

| | | | | |
|---|---|---|---|---|
| 5,555,582 | A * | 9/1996 | Jerideau | A61G 5/006 5/600 |
| 6,272,702 | B1 * | 8/2001 | Uchida | A61G 5/006 5/600 |
| 6,742,206 | B1 * | 6/2004 | Han | A61G 5/006 280/250.1 |
| 6,866,288 | B2 * | 3/2005 | Martin | A61G 5/006 280/250.1 |
| 7,774,873 | B2 * | 8/2010 | Martin | A61G 5/10 5/611 |
| 2001/0029629 | A1 * | 10/2001 | Tsuji | A61G 5/006 5/618 |
| 2003/0193166 | A1 | 10/2003 | Martin | |
| 2006/0191073 | A1 * | 8/2006 | Honda | A61G 5/006 5/600 |
| 2007/0096525 | A1 * | 5/2007 | McElhinney | A47C 3/30 297/339 |
| 2012/0153687 | A1 | 6/2012 | Kume et al. | |
| 2012/0159705 | A1 | 6/2012 | Tsukada et al. | |
| 2014/0327232 | A1 | 11/2014 | He | |

FOREIGN PATENT DOCUMENTS

| | | |
|---|---|---|
| CN | 201755293 | 3/2011 |
| CN | 102481219 | 5/2012 |
| CN | 103156743 | 6/2013 |
| JP | 2002-238953 | 8/2002 |
| JP | 2012-65758 | 4/2012 |
| WO | 2011/155177 | 12/2011 |

OTHER PUBLICATIONS

Extended European Search Report issued Dec. 23, 2015 in European Application No. 14846721.0.

Written Opinion of the International Searching Authority issued Oct. 7, 2014 in International (PCT) Application No. PCT/JP2014/004739, with English translation.

International Search Report issued Oct. 7, 2014 in International (PCT) Application No. PCT/JP2014/004739.

* cited by examiner

SEPARABLE BED

TECHNICAL FIELD

The present invention relates to a separable bed that can be utilized as a wheelchair by separating a part of the separable bed.

BACKGROUND ART

In a hospital or a caring facility, a patient, a care receiver, or the like (hereinafter collectively abbreviated as a "care receiver") is sometimes transferred from a bed to a wheelchair, or a care receiver is sometimes transferred from a wheelchair to a bed. Support for such transfer is generally performed by hands of a human such a nurse or a caregiver (hereinafter collectively abbreviated as a "caregiver"), but is a physical burden on the caregiver, and causes lumbago.

In order to reduce the physical burden on the caregiver in the support for such transfer, a separable bed that can be utilized as a wheelchair by separating a part of the separable bed is proposed (see Patent Literature 1, for example).

FIG. 6A and FIG. 6B each show a conventional separable bed 21. As shown in FIG. 6A, the separable bed 21 in a separated state is composed of a wheelchair portion 22 and a bed portion 23. As shown in FIG. 6B, in the separable bed 21 in a combined state, a bed bottom on which a care receiver lies is formed by integrating the wheelchair portion 22 and the bed portion 23. The separable bed 21 in the combined state can be utilized as a general electric bed.

By the separable bed 21 having such a configuration, a caregiver can easily perform transfer between the bed and the wheelchair alone.

CITATION LIST

Patent Literature

Patent Literature 1: WO 2011/155177 A

SUMMARY OF INVENTION

Technical Problem

In a care-giving site, the whole of a bed is often lowered to a lowest limit position so as to reduce impact in a case where a care receiver lying on the bed turns over and falls from the bed. However, in a configuration of the conventional separable bed 21, when the bed is lowered to the lowest limit position, there is a possibility that wheels of the wheelchair portion 22 are grounded on a floor, and the wheelchair portion 22 is separated from the bed portion 23.

The present invention has been made in view of such a problem, and an object of the present invention is to provide a separable bed that can be safely utilized.

Solution to Problem

In accomplishing the objects, a separable bed according to one aspect of the present invention comprises:

a bed portion; and a separation portion that is combined with the bed portion to compose the separable bed, wherein the separation portion comprises a second seat portion, and a second guide portion that supports the second seat portion, the bed portion comprises a first bed bottom portion, a first guide portion that supports the first bed bottom portion, and supports the second seat portion at a time of combination, a lifter that lifts the first guide portion, and a controller that controls lifting operation of the lifter, the controller lowers the first bed bottom portion to a second lower limit position in a case where there is a separating instruction for separating the separation portion from the bed portion, and controls the lifting operation of the lifter to lower the first bed bottom portion to a first lower limit position in a case where there is not the separating instruction, and the first lower limit position is higher than the second lower limit position that is a lower side position, and is an intermediate position where the separation portion is not in contact with a floor.

Advantageous Effects of Invention

The above aspect of the present invention can provide the separable bed that can be safely utilized.

DESCRIPTION OF EMBODIMENTS

Figure 1A:
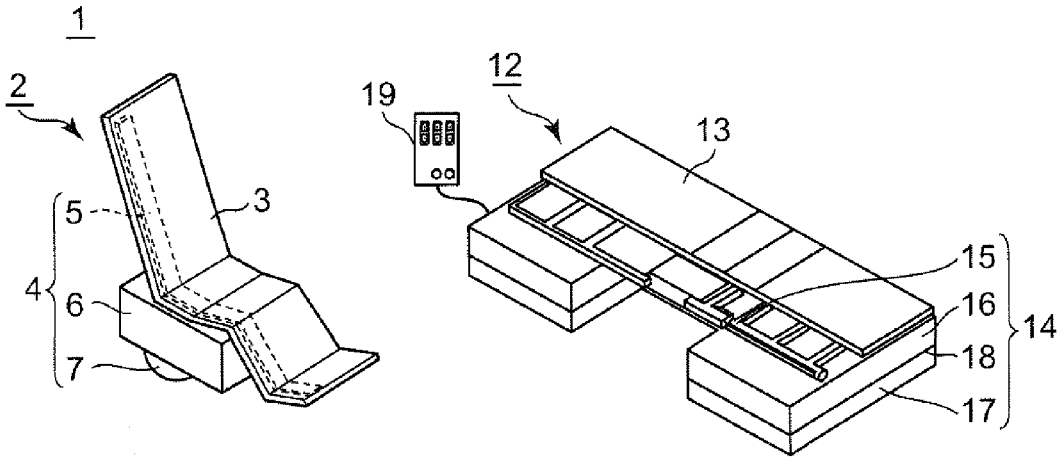
FIG. 1A is a schematic perspective view showing a separated state of a separable bed of a first embodiment of the present invention.

Hereinafter, an embodiment of the present invention is described with reference to the drawings. The same components are denoted by the same reference numerals, and description thereof is sometimes omitted. In order to facilitate understanding, the drawings schematically mainly illustrate the respective components.

First Embodiment

Figure 1B:
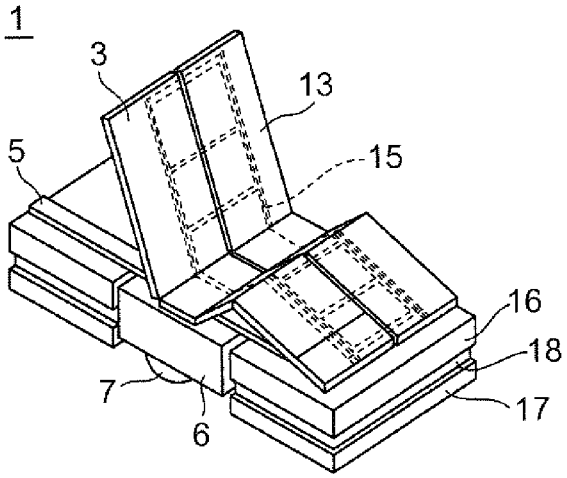
FIG. 1B is a schematic perspective view showing a combined state of the separable bed of the first embodiment.
Figure 1C:
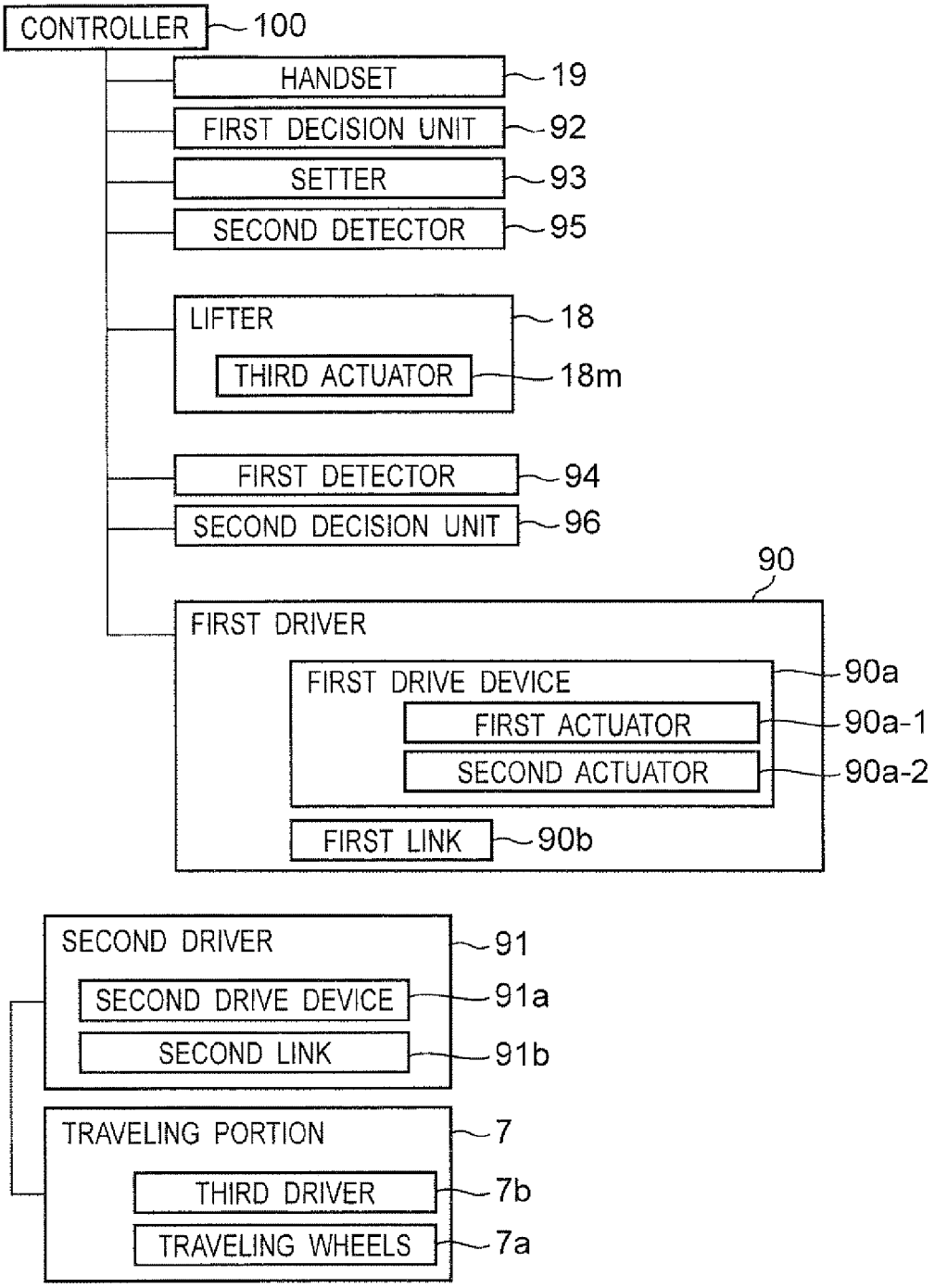
FIG. 1C is a block diagram showing a configuration of a drive system of the separable bed of the first embodiment.

FIG. 1A and FIG. 1B each are a schematic perspective view of a separable bed 1 according to a first embodiment of the present invention. FIG. 1A is a schematic perspective view showing a separated state of the separable bed 1. FIG. 1B is a schematic perspective view showing a combined state of the separable bed 1. FIG. 1C is a block diagram showing a configuration of a drive system of the separable bed of the first embodiment.

The separable bed 1 of the first embodiment is composed by combining a wheelchair portion 2 that functions as an example of a separation portion, and a bed portion 12. Examples of the separation portion include a stretcher, and a shower chair, in addition to the wheelchair portion such as a manual or electric wheelchair. That is, the example of the separation portion functions as an electric bed when combined with the bed portion 12. In the combined state, the separable bed 1 is an electric reclining bed for care that changes its posture by a first driver (drive unit) 90, for example. The first driver 90 is, for example, a bed driver for changing a posture of a bed and lifting (moving up and down) the bed. In the separated state, the wheelchair portion 2 is, for example, an electric reclining wheelchair that changes its posture by a second driver (drive unit) 91. The second driver 91 is, for example, a wheelchair driver for changing a posture of a wheelchair.

The wheelchair portion 2 is composed of at least a second seat portion 3 composed by freely bendably coupling a plurality of divided portions, and a second guide portion 5 that supports the second seat portion 3. The second seat portion 3 is an example of a separation portion seat portion, for example, a wheelchair seat portion. The wheelchair seat portion is, for example, a support member that supports a person on a wheelchair, and a wheelchair bottom. The second guide portion 5 is an example of a separation portion guide portion, for example, a wheelchair guide portion.

The second guide portion 5 can be composed as a part of a second main body portion 4. The second main body portion 4 is an example of a separation portion main body portion, for example, a wheelchair main body portion. In this case, the second main body portion 4 is composed of the second guide portion 5, a second base portion 6 that fixes a part of the second guide portion 5 (e.g., part corresponding to the vicinity of buttocks of a care receiver), and a traveling portion 7 that supports the second base portion 6 and moves the whole of the wheelchair portion 2. The second base portion 6 is an example of a separation portion base portion, for example, a wheelchair base portion that is a base of a wheelchair. The traveling portion 7 has a plurality of traveling wheels 7*a*, and a third driver (drive unit) 7*b* such as motors that normally or reversely rotate the traveling wheels 7*a*. The wheelchair portion 2 further has the second driver 91 as described above. The second driver 91 is composed of a second drive device 91*a*, a second link 91*b* that is coupled to the second guide portion 5 and the second drive device 91*a*, and changes a posture of the second guide portion 5 by the drive of the second drive device 91*a*. The second drive device is, for example, a linear actuator. The second link 91*b* is, for example, a wheelchair link for changing a posture of a seat portion of a wheelchair. The second guide portion 5 is composed of a plurality of divided portions, and is bendable between the adjacent divided portions. Accordingly, other divided portions are bent based on a divided portion located on the part fixed to the second base portion 6 (e.g., part corresponding to the vicinity of buttocks of a care receiver) by the drive of the second drive device 91*a*, so that the second guide portion 5 can change a posture between a flat posture and a sitting posture. The wheelchair portion 2 is composed such that a posture of the second seat portion 3 changes according to the change of a posture of the second guide portion 5, when the second driver 91 changes the posture of the second guide portion 5. In the first embodiment, divided portions that compose the second seat portion 3 are bendable, and therefore the second seat portion 3 cannot maintain a fixed posture. Namely, in the first embodiment, the second seat portion 3 maintains or changes the posture integrally with the posture of the second guide portion 5.

The bed portion 12 is composed of at least a first bed bottom portion 13 composed by freely bendably coupling plurality of divided portions, a first guide portion 15 that supports the first bed bottom portion 13, and a lifter (lifting unit) 18 that performs lifting operation of the first bed bottom portion 13. The first bed bottom portion 13 is, for example, a bed bottom portion. The bed bottom portion is, for example, a support member that supports a person on a bed, and is a bed bottom. The first guide portion 15 and the lifter 18 can also compose as a part of a first main body portion 14. The first main body portion 14 is, for example, a bed main body portion. In this case, the first main body portion 14 can be composed of the first guide portion 15, a first upper portion 16 that fixes a part of the first guide portion 15 (e.g., part corresponding to the vicinity of buttocks of a care receiver), a first base portion 17 that supports the first upper portion 16, and the lifter 18 that performs lifting operation of the first upper portion 16 (i.e., first guide portion 15) relative to the first base portion 17. The first upper portion 16 is, for example, a bed upper portion that is an upper member of the bed portion. The first base portion 17 is, for example, a bed base portion that is a lower member being a base of the bed portion. The lifter 18 is composed of a third actuator 18*m*, and a third link 18*a* that lifts the first guide portion 15 by the drive of the third actuator 18*m*. The third actuator 18*m* is, for example, a lifting linear actuator such as a lifting motor. The third link 18*a* is, for example, a lifting link. The third link 18*a* is coupled to the first guide portion 15 and the third actuator 18*m*. Instructions of rising/lowering operation to the third actuator 18*m* of the lifter 18 are performed by a handset 19 described later. In the first embodiment, the divided portions composing the first bed bottom portion 13 are freely bent, and therefore the first bed bottom portion 13 cannot maintain a fixed shape. As shown in FIG. 4A to FIG. 5C, the bed portion 12 may have wheels 37 at the lower ends of four corners to be movable.

The bed portion 12 further has the first driver 90. The first driver 90 is composed of a first drive device 90*a*, and a first link 90*b* that is coupled to the first guide portion 15 and the first drive device 90*a*, and changes a posture of the first guide portion 15 by the drive of the first drive device 90*a*. The first link 90*b* is, for example, a bed link for changing a posture of a bed bottom portion of a bed portion. The first guide portion 15 is composed of a plurality of divided portions, and is bendable between the adjacent divided portions. The first drive device 90*a* is composed of a first actuator 90*a*-1 and a second actuator 90*a*-2. The first actuator 90*a*-1 is a linear actuator for performing bending operation or bend releasing operation of a divided portion related to back lifting of the first guide portion 15. The second actuator 90*a*-2 is a linear actuator for performing bending operation or bend releasing operation of divided portions related to knee lifting of the first guide portion 15. Accordingly, other divided portions are bent based on a divided portion located on the part fixed to the first upper portion 16 (e.g., part corresponding to the vicinity of buttocks of a care receiver) by the drive of the first drive device 90*a*, so that the first guide portion 15 can change the posture between the flat posture and a back lifting posture-and-knee lifting posture. Accordingly, the first bed bottom portion 13 is composed such that a posture of the first bed bottom portion 13 changes according to the change of a posture of the first guide portion 15, when the first driver 90 changes the posture of the first guide portion 15. That is, the first bed bottom portion 13 maintains or changes the posture integrally with the posture of the first guide portion 15.

The separable bed 1 further includes a controller (control unit) 100 that controls combination operation and separation operation, the handset 19 that is an example of an input unit, a first decision unit 92, a setter (setting unit) 93, and a second decision unit 96. The first decision unit 92 is, for example, an instruction decision unit that decides instructions input to the handset 19. The second decision unit 96 is, for example, a height decision unit that decides the height of the first upper portion 16. The setter 93 is, for example, a lower limit value setter (setting unit) that sets a lower limit value of the height of the first upper portion 16. The handset 19 is desirably provided in the bed portion 12.

The controller 100 controls lifting operation of the lifter 18. More specifically, the controller 100 controls the drive of the third actuator 18*m* of the lifter 18 and the drive of the first drive device 90*a* of the first driver 90, in accordance with instructions input by the handset 19 and decided by the first decision unit 92. During lowering operation, after the setter 93 sets a lower limit value, the controller 100 controls the drive of the third actuator 18*m* of the lifter 18 so as to lower the first upper portion 16 to the set lower limit value. Hereinafter, respective components are described in detail.

Figure 1D:
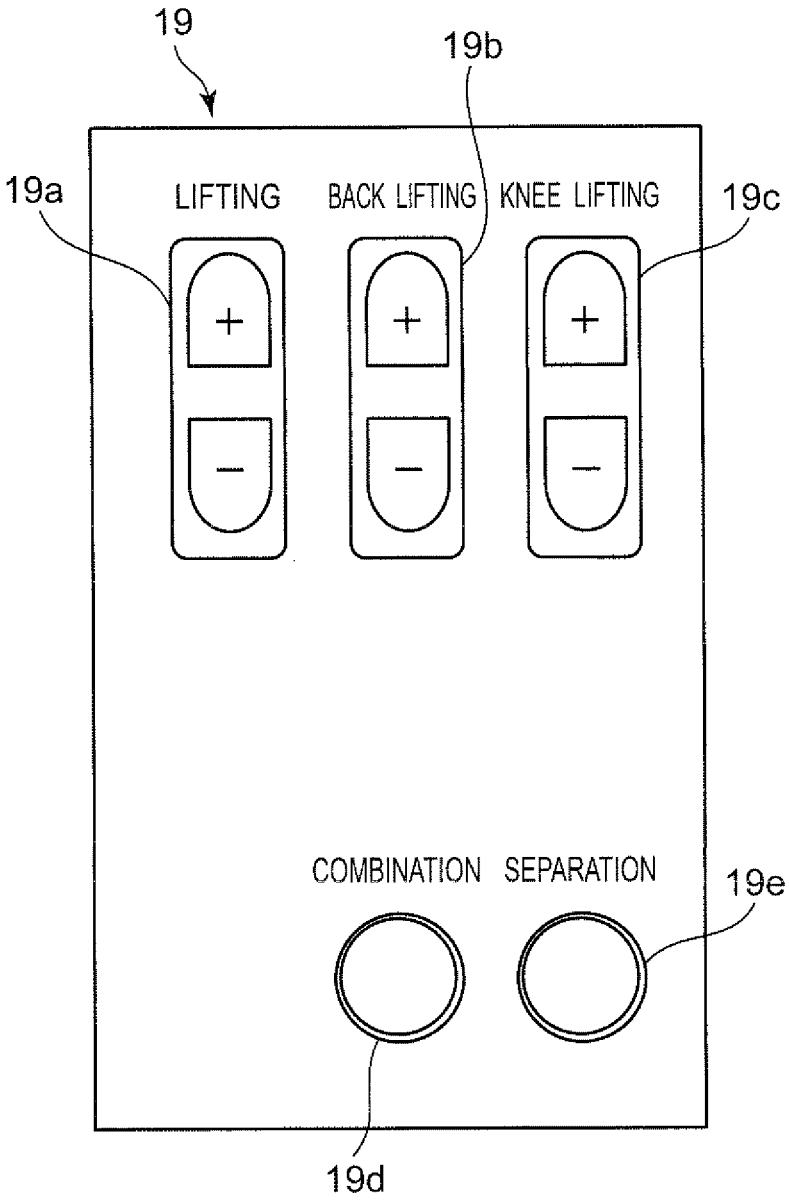
FIG. 1D is a front view of a handset of the separable bed of the first embodiment.

FIG. 1D is a view showing a manipulation surface of the handset 19. The handset 19 has a first button 19*a*, a second button 19*b*, a third button 19*c*, a fourth button 19*d*, and a fifth button 19*e*, as an example. The first button 19*a* is, for example, a lifting button for a lifting (moving-up-and-down) instruction. The second button 19*b* is, for example, a back lifting button for a back lifting instruction. The third button 19*c* is, for example, a knee lifting button for a knee lifting instruction. The fourth button 19*d* is, for example, a combining button for a combining Instruction. The fifth button 19*e* is, for example, a separating button for a separating instruction. The handset 19 is connected to the controller 100 of the bed portion 12 by wire or wirelessly. When any of the buttons 19*a* to 19*e* of the handset 19 is manipulated, the controller 100 controls operation of the first actuator 90*a*-1 and the second actuator 90*a*-2 of the first drive device 90*a*, or operation of the third actuator 18*m* of the lifter 18, on the basis of instruction information input to the first decision unit 92.

The first button 19*a* is a switch that drives the third actuator 18*m* of the lifter 18. The first button 19*a* vertically changes the heights of the first bed bottom portion 13 and the like (hereinafter, referred to as the "first bed bottom portion 13 and the like" when the first bed bottom portion 13, the first guide portion 15, and the first upper portion 16 are integrally handled) of the separable bed 1 after combination, within a bed liftable range.

The second button 19*b* is a switch that drives the first actuator 90*a*-1, and performs back lifting operation or back lowering operation of the separable bed 1.

The third button 19*c* is a switch that drives the second actuator 90*a*-2, and performs knee lifting operation or knee lowering operation of the separable bed 1.

The fourth button 19*d* is a switch for driving the third actuator 18*m* of the lifter 18 to combine the separated separable bed 1 (that is, to combine the wheelchair portion 2 with the bed portion 12). While the fourth button 19*d* is pressed, the controller 100 raises the first bed bottom portion 13 and the like to an upper end position for combination operation by the drive of the third actuator 18*m*.

The fifth button 19*e* is a switch for driving the third actuator 18*m* of the lifter 18 to separate the combined separable bed 1. While the fifth button 19*e* is pressed, the controller 100 lowers the first bed bottom portion 13 and the like to a second lower limit position by the drive of the third actuator 18*m*. Although later described in detail, the second lower limit position is a position where the wheelchair portion 2 and the bed portion 12 can be separated, which is a lower limit position for lowering for separation operation.

The first decision unit 92 decides on the basis of information inputted from the handset 19 whether either the separation operation for separating the wheelchair portion 2 from the bed portion 12, or the lowering operation as an electric caring bed is performed. The first decision unit 92 outputs a result of this decision to the controller 100.

The setter 93 sets a lower limit value when the first bed bottom portion 13 and the like are lowered, on the basis of the decision result by the first decision unit 92. The lower limit value is previously decided, and is stored in, for example, a storage inside the setter 93. On the basis of the decision result by the first decision unit 92, the lower limit value stored in this storage is selected and set. When the first bed bottom portion 13 and the like are lowered, the controller 100 controls the drive of the third actuator 18*m* of the lifter 18 to the lower limit value set by the setter 93.

The second decision unit 96 compares a height detected by a first detector (detection unit) 94 mounted on the third actuator 18*m* (height Lb of the first bed bottom portion 13) with the lower limit value set by the setter 93 to output a comparison result to the controller 100. The first detector 94 is a height detection sensor as an example of a height detector.

The controller 100 controls the drive of the third actuator 18*m* on the basis of the comparison result by the second decision unit 96.

As shown in FIG. 1A, in the wheelchair portion 2 in a wheelchair state, separated from the bed portion 12, the second driver 91 is driven, so that the second guide portion 5 that is a posture change mechanism for a wheelchair changes the posture of the second seat portion 3. As shown in FIG. 1B, in a bed state where the wheelchair portion 2 is combined with the bed portion 12, the posture change mechanism of the second seat portion 3 in this embodiment is switched from the second guide portion 5 to the first guide portion 15. In the wheelchair portion 2 in the bed state, the first driver 90 is driven, so that the second seat portion 3 and the first bed bottom portion 13 are integrated to perform posture change by the first guide portion 15 that is a posture change mechanism for a bed. At this time, as shown in FIG. 1B, the second guide portion 5 is located in parallel to the first upper portion 16 with a flat posture so as not to structurally interfere with the first upper portion 16. Thus, the posture change mechanism of the second seat portion 3 is switched between the bed state and the wheelchair state, so that in the wheelchair state after separation, the wheelchair portion 2 can change the posture of the second seat portion 3 to a sitting posture peculiar to a wheelchair, as a general reclining wheelchair. Additionally, in the bed state after combination, the wheelchair portion 2 and the bed portion 12 can integrally change the posture of the second seat portion 3 and the posture of the first bed bottom portion 13 to a back lifting posture and a knee lifting posture peculiar to a bed, as an electric caring bed.

Figure 2:
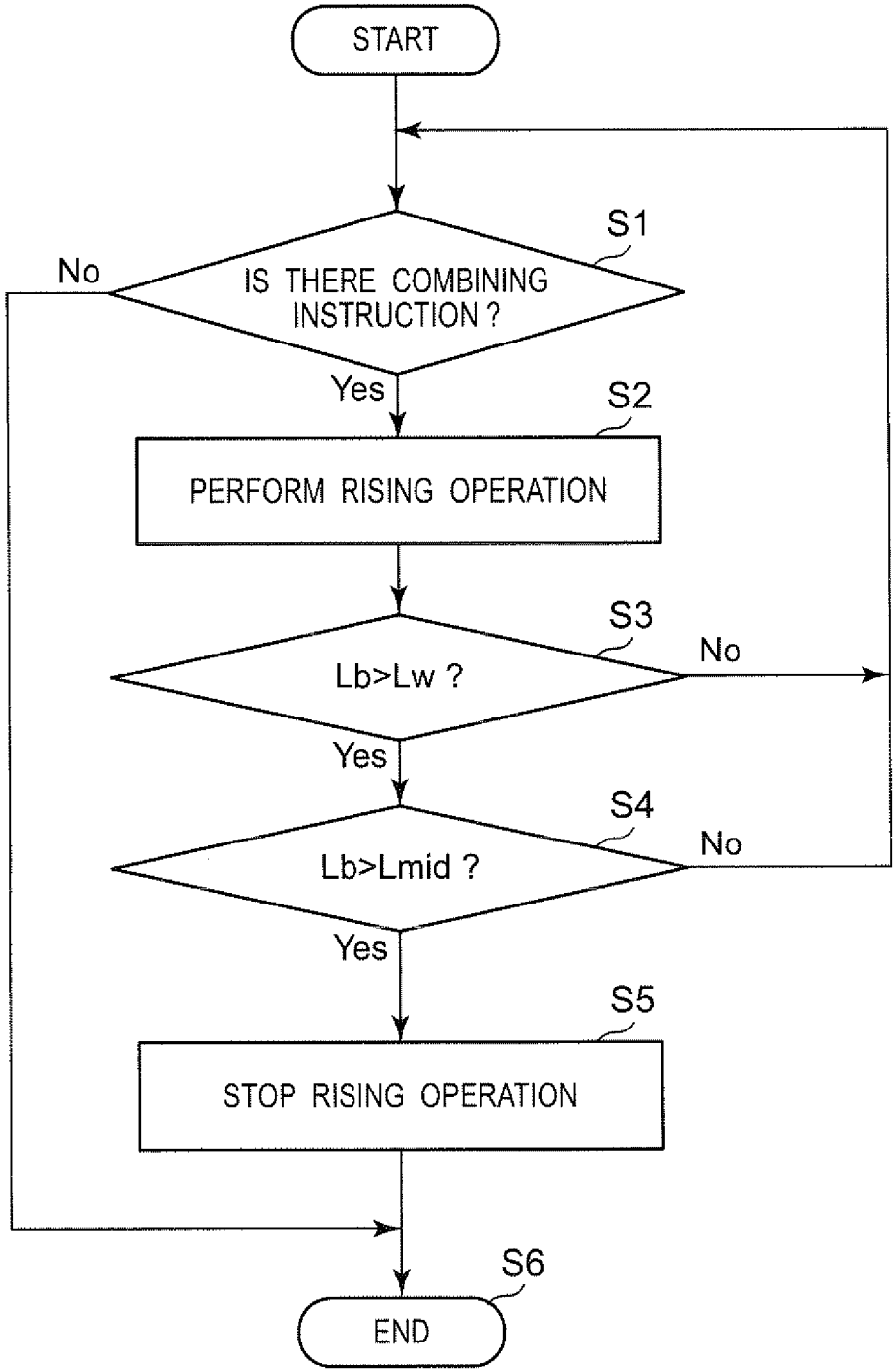
FIG. 2 is a flowchart showing combination operation of the separable bed of the first embodiment.
Figure 3:
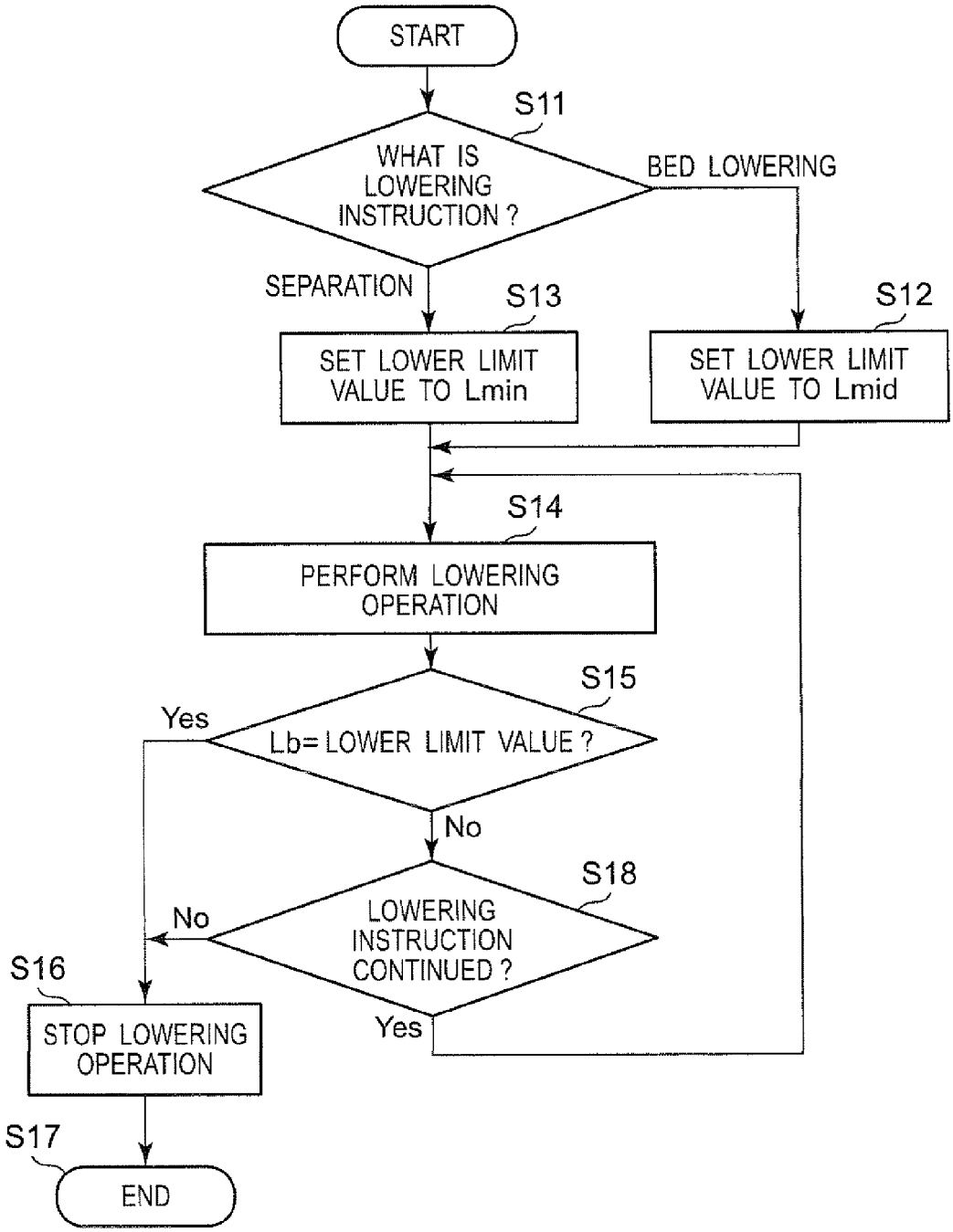
FIG. 3 is a flowchart showing separation operation of the separable bed of the first embodiment.

Now, operation of the separable bed 1 composed as described above is described. FIG. 2 is a flowchart showing the combination operation of the separable bed of the first embodiment, and FIG. 3 is a flowchart showing the separation operation of the separable bed of the first embodiment.

Figure 4A:
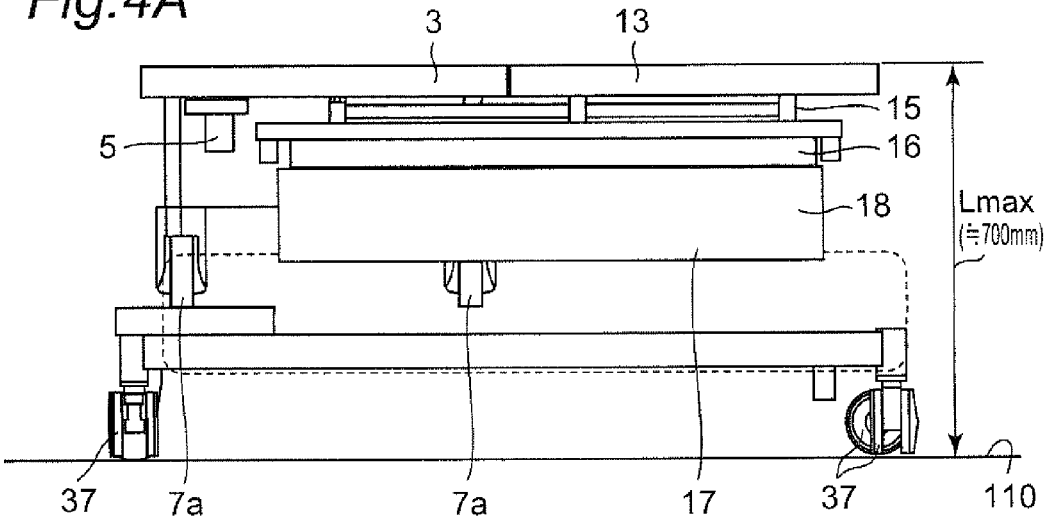
FIG. 4A is a front view of the separable bed in the combined state at the start of lowering a first bed bottom portion, in the separable bed of the first embodiment.
Figure 4B:
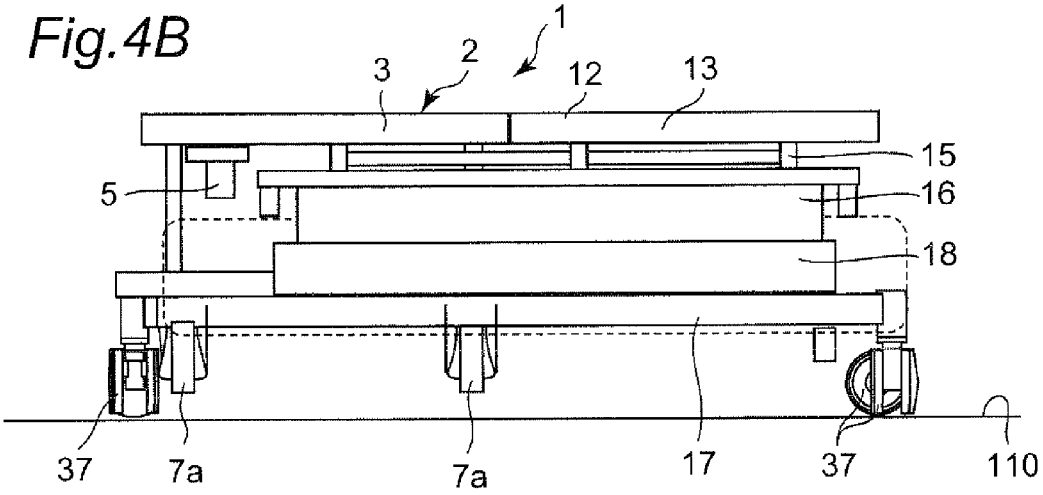
FIG. 4B is a front view of the separable bed in the combined state in the middle of the lowering of the first bed bottom portion, in the first embodiment.

Herein, the initial height of the second seat portion 3 to a floor 110 in a case where the second seat portion 3 is in a flat posture is denoted by Lw (see FIG. 4C and FIG. 5C), and the height of the first bed bottom portion 13 to the floor 110 is denoted by Lb. The initial height Lw is a distance from the lower surface of the traveling portion 7 to the upper surface of the second seat portion 3. The initial height Lw of the second seat portion 3 in a case where the wheelchair portion 2 is in the wheelchair state is a fixed value (e.g., 400 mm). The height Lb of the first bed bottom portion 13 is a variation value that changes by lifting operation of the lifter 18 (e.g., 300 mm to 700 mm). A height when the first bed bottom portion 13 rises most by the lifting operation of the lifter 18 is defined as an upper side position Lmax (e.g., 700 mm) (see FIG. 4A and FIG. 5A), and a height when the first bed bottom portion 13 lowers most by the ting operation of the lifter 18 is defined as a lower side position Lmin (e.g., 300 mm). Additionally, a height when the first bed bottom portion 13 slightly rises compared to the initial height Lw (e.g., 400 mm) of the second seat portion 3 is defined as an intermediate position Lmid (e.g., 410 mm). Herein, the intermediate position Lmid is a position showing a state where the first guide portion 15 supports and lifts up the second seat portion 3. Additionally, the intermediate position Lmid is such a height that the wheels of the wheelchair portion 2 are not grounded on the floor 110, and a first lower limit position in the lowering operation as an electric caring bed. FIG. 4A and FIG. 5A each illustrate the height of the upper side position Lmax that is reduced with compared to the initial height Lw, due to a reason of a space of a sheet. Accordingly, a movable range (bed liftable range) of the first bed bottom portion 13 and the like is a range in which the height of the upper surface of the first bed bottom portion is between the upper side position Lmax and the lower side position Lmin. In light of deflection of the separable bed 1, or cushioning properties of the traveling wheels 7*a*, a difference between the intermediate position Lmid and the lower side position Lmin is preferably at least 10 mm or more.

The second decision unit 96 compares the height Lb of the first bed bottom portion 13 detected by the first detector 94 with a predetermined value. For example, when the first bed bottom portion 13 and the like rise, the second decision unit 96 decides whether or not the height Lb of the first bed bottom portion 13 is higher than the initial height Lw of the second seat portion 3, and thereafter decides whether or not the height Lb of the first bed bottom portion 13 is higher than the intermediate position Lmid.

Herein, when the height Lb of the first bed bottom portion 13 is the initial height Lw of the second seat portion 3 or less, the second seat portion 3 is supported by the second guide portion 5. When the height Lb of the first bed bottom portion 13 is higher than the initial height Lw of the second seat portion 3, the support of the second seat portion 3 is switched from the second guide portion 5 to the first guide portion 15. In a case where it is decided whether either the second guide portion 5 or the first guide portion 15 supports the second seat portion 3, comparison decision between the height Lb of the first bed bottom portion 13 and the initial height Lw of the second seat portion 3 is performed.

Thereafter, the controller 100 performs comparison decision between the height Lb of the first bed bottom portion 13 and the intermediate position Lmid, and raises the first bed bottom portion 13 until the height Lb of the first bed bottom portion 13 becomes higher than the intermediate position Lmid, to confirm the completion of the combination operation.

On the other hand, in this embodiment, when the first bed bottom portion 13 and the like lower, only in a case where there is a separating instruction, the controller 100 lowers the height Lb of the first bed bottom portion 13 to the second lower limit position (lower side position Lmin), to reliably ground the traveling wheels 7*a* of the wheelchair portion 2 to the floor 110, so that the wheelchair portion 2 is safely separable from the bed portion 12. Even in the same lowering operation of the first bed bottom portion 13 and the like, when the lowering operation is performed in the bed state, the height Lb of the first bed bottom portion 13 is lowered only to the first lower limit position (intermediate position Lmid). That is, the height Lb of the first bed bottom portion 13 is not lower than the intermediate position Lmid, and therefore the wheelchair portion 2 is grounded on the floor 110, so that the combined state can be prevented from becoming unstable.

Hereinafter, the combination operation for combining the wheelchair portion 2 with the bed portion 12 in order to switch the wheelchair state (state of FIG. 1A) to the bed state (state of FIG. 1B) is described with reference to FIG. 2.

Figure 4C:
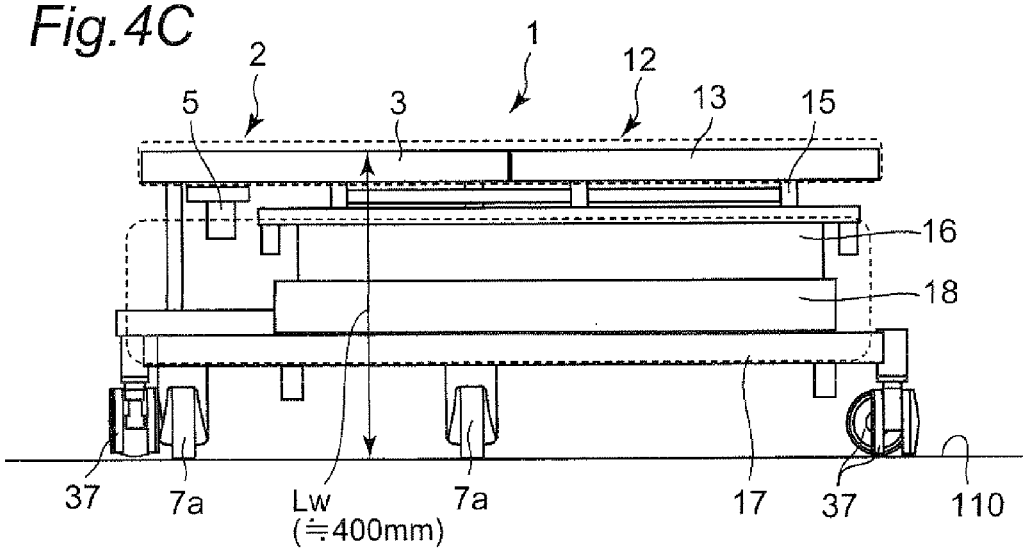
FIG. 4C is a front view of the separable bed in the combined state at a first lower limit position of the first bed bottom portion, in the first embodiment.
Figure 5A:
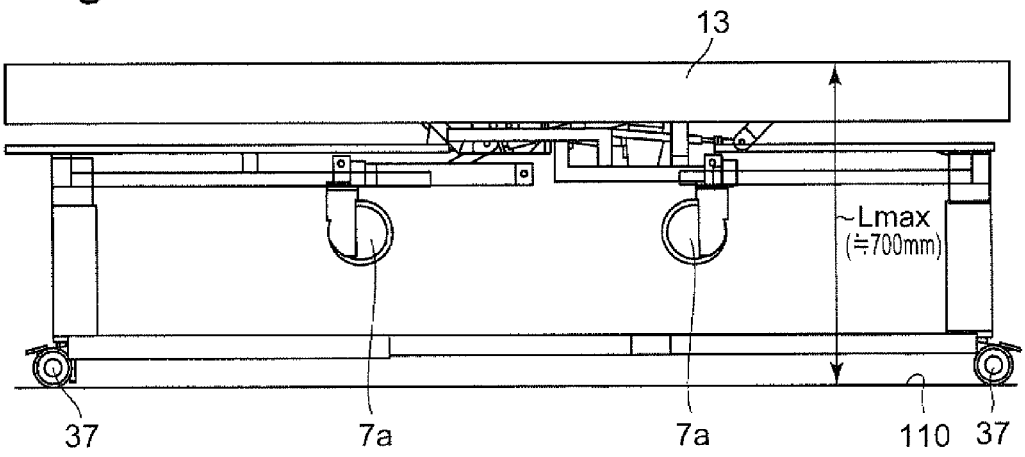
FIG. 5A is a right side view of the separable bed in the combined state at the start of lowering the first bed bottom portion, in the separable bed of the first embodiment.
Figure 5B:
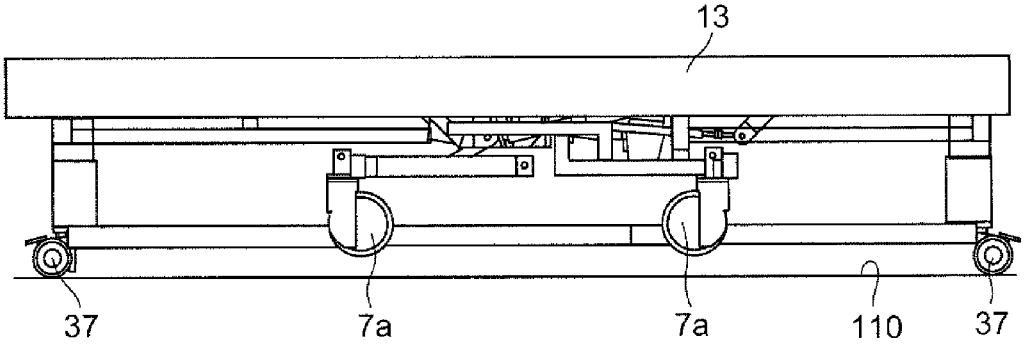
FIG. 5B is a right side view of the separable bed in the combined state in the middle of the lowering of the first bed bottom portion, in the first embodiment.
Figure 5C:
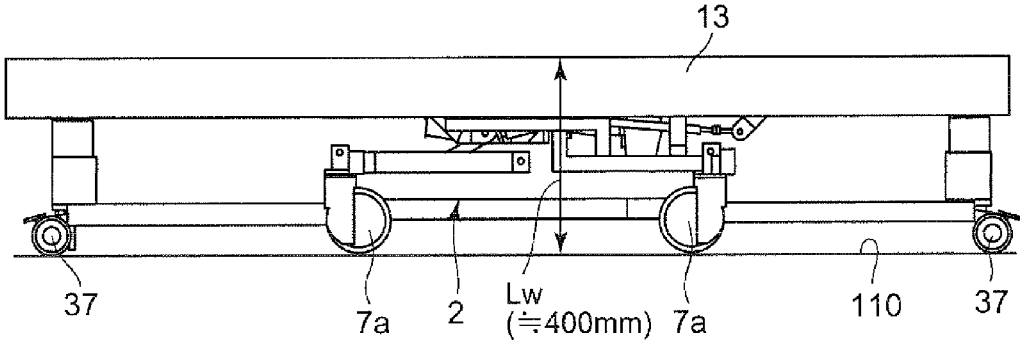
FIG. 5C is a right side view of the separable bed in the combined state at the first lower limit position of the first bed bottom portion, in the first embodiment.
Figure 6A:
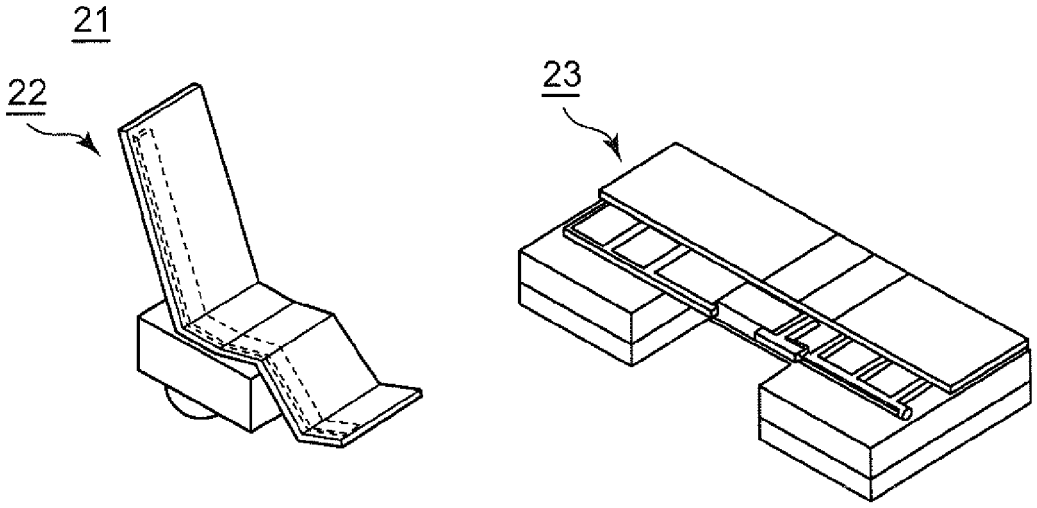
FIG. 6A is a schematic perspective view showing a separated state of a conventional separable bed.
Figure 6B:
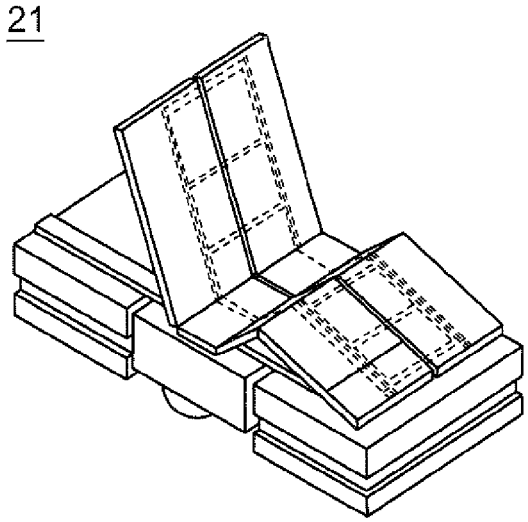
FIG. 6B is a schematic perspective view showing a combined state of the conventional separable bed.

First, as shown in FIG. 4C and FIG. 5C, the second seat portion 3 is made to be in a full flat posture, and the second base portion 6 of the wheelchair portion 2 is disposed so as to be incorporated in a recessed portion 12*g* of the side surface of the bed portion 12.

In this state, the first decision unit 92 decides whether or not there is a combining instruction from the handset 19 (Step S1). Specifically, the first decision unit 92 decides whether or not the fourth button 19*d* of the handset 19 is pressed.

When the first decision unit 92 decides that there is no combining instruction from the handset 19 in Step S1 (No in Step S1), the controller 100 ends the processes of the combination operation.

When the first decision unit 92 decides that there is the combining instruction from the handset 19 in Step S1 (Yes in Step S1), the controller 100 causes the lifter 18 to raise the first bed bottom portion 13 and the like, and starts the combination operation (Step S2).

Then, the controller 100 causes the second decision unit 96 to decide whether or not the height Lb of the first bed bottom portion 13 detected by the first detector 94 is higher than the initial height Lw of the second seat portion 3 (Step S3).

When the second decision unit 96 decides that the height Lb of the first bed bottom portion 13 is the initial height Lw of the second seat portion 3 or less in Step S3 (No in Step S3), the controller 100 determines that the second seat portion 3 is supported by the second guide portion 5, and returns to Step S1.

When the second decision unit 96 decides that the height Lb of the first bed bottom portion 13 is higher than the initial height Lw of the second seat portion 3 in Step S3 (Yes in Step S3), the process proceeds to Step S4. At this time, the support of the second seat portion 3 is switched from support by the second guide portion 5 to support by the first guide portion 15. That is, this means that the posture change mechanism of the second seat portion 3 is switched from the second guide portion 5 to the first guide portion 15.

In Step S4, when the lifter 18 further continues to raise the first bed bottom portion 13, the first guide portion 15, and the first upper portion 16, the second decision unit 96 decides whether or not the height Lb of the first bed bottom portion 13 is higher than the intermediate position Lmid (Step S4). When the second decision unit 96 decides that the height Lb of the first bed bottom portion 13 is the intermediate position Lmid or less in Step S4 (No in Step S4), the process returns to Step S1, and the combination operation is continued. When the second decision unit 96 decides that height Lb of the first bed bottom portion 13 is higher than the intermediate position Lmid in Step S4 (Yes in Step S4), the process proceeds to Step S5.

In Step S5, under the control of the controller 100, the rising operation by the lifter 18 is stopped, and thereafter the combination operation is completed (Step S6). A state where the combination operation is completed is a state shown in FIG. 4A and FIG. 5A through a middle state shown in FIG. 4B and FIG. 5B.

When the combination operation is completed, the wheelchair portion 2 is in a state where the first main body portion 14 is completely lifted up as shown in FIG. 4A and FIG. 5A, and is safely operated as an electric caring bed, and therefore becomes in the bed state.

In the first embodiment, the combination operation for combining the separated wheelchair portion 2 with the bed portion 12 is performed by such rising operation of the first bed bottom portion 13 by the lifter 18, to shifts from the wheelchair state to the bed state.

Then, in a case where the first decision unit 92 decides that there is a lowering instruction from the handset 19, there are two types of operations, namely, separation operation for switching the bed state (state of FIG. 1B) to the wheelchair state (state of FIG. 1A) (lowering operation for separating the wheelchair portion 2 from the bed portion 12), and lowering operation as an electric caring bed, and it is necessary to clearly distinguish the both with reference to FIG. 3. The following processes are not applied in a case where there is no lowering instruction from the handset 19.

First, in Step S11, the first decision unit 92 decides whether an instruction from the handset 19 is an instruction as to lowering of the first bed bottom portion 13 and the like for separation or an instruction as to bed lowering of the first bed bottom portion 13 and the like in the bed state.

Herein, in the separable bed 1 that is in the combined state (bed state), when the first decision unit 92 decides that there is instruction information from the first button 19*a*, the process proceeds to Step S12. In this case, the first decision unit 92 decides that the instruction information from the first button 19*a* is the instruction as to the bed lowering of the first bed bottom portion 13 and the like in the bed state (lowering as an electric caring bed).

Additionally, whether or not the separable bed is in the combined state is based on output information from a second detector (detection unit) 95 to the controller 100 and the first decision unit 92. An example of the second detector 95 is a combined state detection sensor that detects whether or not the wheelchair portion 2 is combined with the bed portion 12. An example of the second detector 95 is a contact sensor that is disposed in the bed portion 12, and detects contact with the wheelchair portion 2.

On the other hand, in the separable bed 1 that is in the combined state (bed state), when the first decision unit 92 decides that there is the instruction information from the fifth button 19*e*, the process proceeds to Step S13. In this case, the first decision unit 92 decides that the instruction information from the fifth button 19*e* is information as to the lowering of the first bed bottom portion 13 and the like for separation.

In Step S12, the setter 93 sets a lifting lower limit value of the height Lb of the first bed bottom portion 13 to the intermediate position Lmid that is the first lower limit position. Thereafter, the process proceeds to Step S14.

In Step S13, the setter 93 sets a lifting lower limit value of the height Lb of the first bed bottom portion 13 to the lower side position Lmin that is the second lower limit position. Thereafter, the process proceeds to Step S14.

In Step S14, the controller 100 lowers the first bed bottom portion 13 and the like by the drive of the third actuator 18*m* so as to lower the first bed bottom portion 13 to the lower limit value set by the setter 93. Thereafter, the process proceeds to Step S15.

In Step S15, the second decision unit 96 decides whether or not the height Lb of the first bed bottom portion 13 reaches the lower limit value set by the setter 93. When the second decision unit 96 decides that the height Lb of the first bed bottom portion 13 reaches the lower limit value in Step S15 (Yes in Step S15), the process proceeds to Step S16.

In Step S16, under the control of the controller 100, the lowering operation by the third actuator 18*m* is stopped. Thereafter, a series of processes are ended (Step S17).

When the second decision unit 96 decides that the height Lb of the first bed bottom portion 13 does not reach the lower limit value set by the setter 93 in Step S15 (No in Step S15), the process proceeds to Step S18.

In Step S18, the first decision unit 92 decides whether or not the instruction from the handset 19 is continued. When the instruction from the handset 19 is continued, the process returns to Step S14 When the instruction from the handset 19 is not continued, the process proceeds to Step S16.

By performing the operation by such control, the height Lb of the first bed bottom portion 13 is not lower than the intermediate position Lmid (see FIG. 4C and FIG. 5C) at the time of the lowering operation in the combined state (bed state). Therefore, the posture change mechanism of the second seat portion 3 is switched from the first guide portion 15 to the second guide portion 5 by grounding the wheelchair portion 2 on the floor 110, so that the support of the second seat portion 3 can be prevented from becoming unstable. That is, in the lowering operation as an electric caring bed, the intermediate position Lmid is made to be the first lower limit position ire the lowering operation, so that a state where the wheelchair portion 2 is completely lifted up by the first main body portion 14 is maintained, and the wheelchair portion 2 can be safely operated as the bed state.

In the first embodiment, under the control of the controller 100, in the lowering operation by the separating instruction, the first bed bottom portion 13 lowers to the lower side position Lmin, and the traveling wheels 7*a* of the wheelchair portion 2 are grounded on the floor 110, and a member supporting the second seat portion 3 is switched from the first guide portion 15 to the second guide portion 5. Therefore, the wheelchair portion 2 is pulled out from the bed portion 12, so that the separable bed 1 is brought into a state capable of separating the wheelchair portion 2. This state is a state where only the first guide portion 15 further lowers with respect to the second seat portion 3 compared to the states of FIG. 4C and FIG. 5C. That is, in a case where the wheelchair portion 2 is separated, the height Lb of the first bed bottom portion 13 is lowered to the second lower limit position (lower side position Lmin), so that only in a case where there is the separating instruction, the controller 100 of the separable bed 1 of the first embodiment can ground the traveling wheels 7*a* of the wheelchair portion 2 on the floor 110, and safely separate the wheelchair portion from the bed portion 12.

By appropriately combining arbitrary embodiments or modifications of the above various embodiments or modifications, the effects possessed by the respective embodiments or modifications can be produced.

INDUSTRIAL APPLICABILITY

A separable bed of the present invention is useful for an ordinary home, a caring facility, or a hospital facility where a person who needs care.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A separable bed comprising:

a bed portion; and a separation portion that is combined with the bed portion to comprise the separable bed, wherein the separation portion comprises a second seat portion, and a second guide portion that supports the second seat portion, the bed portion comprises a first bed bottom portion, a first guide portion that supports the first bed bottom portion, and supports the second seat portion at a time of combination, a lifter that lifts the first guide portion, and a controller that controls lifting operation of the lifter, the controller lowers the first bed bottom portion to a second lower limit position in a case where there is a separating instruction for separating the separation portion from the bed portion, and controls the lifting operation of the lifter to lower the first bed bottom portion to a first lower limit position in a case where there is not the separating instruction, and the first lower limit position is higher than the second lower limit position that is a lower side position, and the first lower limit position is an intermediate position where the separation portion is not in contact with a floor.

2. The separable bed according to claim 1, wherein the separation portion is a wheelchair having a traveling wheel that when in contact with the floor is capable of traveling thereon, and the first lower limit position is a position where the traveling wheel of the wheelchair is not in contact with the floor.

3. The separable bed according to claim 1, wherein the separation portion is a stretcher or a shower chair.

4. The separable bed according to claim 1, wherein the controller further comprises a first detector that detects a height of the first bed bottom portion, and a second decision unit that decides the height of the first bed bottom portion detected by the first detector, the controller drives the lifter, and controls the lifting operation of the lifter so as to lower the first bed bottom portion until the second decision unit decides that the height of the first bed bottom portion is the first lower limit position, in a case where there is not the separating instruction, and the controller drives the lifter, and controls the lifting operation of the lifter so as to lower the first bed bottom portion until the second decision unit decides that the height of the first bed bottom portion is the second lower limit position, in a case where there is the separating instruction.

5. The separable bed according to claim 2, wherein the controller further comprises a first detector that detects a height of the first bed bottom portion, and a second decision unit that decides the height of the first bed bottom portion detected by the first detector, the controller drives the lifter, and controls the lifting operation of the lifter so as to lower the first bed bottom portion until the second decision unit decides that the height of the first bed bottom portion is the first lower limit position, in a case where there is not the separating instruction, and the controller drives the lifter, and controls the lifting operation of the lifter so as to lower the first bed bottom portion until the second decision unit decides that the height of the first bed bottom portion is the second lower limit position, in a case where there is the separating instruction.

6. The separable bed according to claim 1, wherein a liftable range of the lifter is a range in which a height of the first bed bottom portion is between an upper side position and the lower side position, and the controller controls the lifting operation of the lifter so as to lower both the first bed bottom portion and the second bed bottom portion between the upper side position and the first lower limit position, and controls the lifting operation of the lifter so as to lower only the first bed bottom portion between the first lower limit position and the second lower limit position.

7. The separable bed according to claim 2, wherein a liftable range of the lifter is a range in which a height of the first bed bottom portion is between an upper side position and the lower side position, and the controller controls the lifting operation of the lifter so as to lower both the first bed bottom portion and the second bed bottom portion between the upper side position and the first lower limit position, and controls the lifting operation of the lifter so as to lower only the first bed bottom portion between the first lower limit position and the second lower limit position.

8. The separable bed according to claim 3, wherein a liftable range of the lifter is a range in which a height of the first bed bottom portion is between an upper side position and the lower side position, and the controller controls the lifting operation of the lifter so as to lower both the first bed bottom portion and the second bed bottom portion between the upper side position and the first lower limit position, and controls the lifting operation of the lifter so as to lower only the first bed bottom portion between the first lower limit position and the second lower limit position.

9. The separable bed according to claim 4, wherein a liftable range of the lifter is a range in which a height of the first bed bottom portion is between an upper side position and the lower side position, and the controller controls the lifting operation of the lifter so as to lower both the first bed bottom portion and the second bed bottom portion between the upper side position and the first lower limit position, and controls the lifting operation of the lifter so as to lower only the first bed bottom portion between the first lower limit position and the second lower limit position.

10. The separable bed according to claim 5, wherein a liftable range of the lifter is a range in which a height of the first bed bottom portion is between an upper side position and the lower side position, and the controller controls the lifting operation of the lifter so as to lower both the first bed bottom portion and the second bed bottom portion between the upper side position and the first lower limit position, and controls the lifting operation of the lifter so as to lower only the first bed bottom portion between the first lower limit position and the second lower limit position.

11. The separable bed according to claim 1, wherein a difference between the first lower limit position and the second lower limit position is 10 mm or more.

12. The separable bed according to claim 2, wherein a difference between the first lower limit position and the second lower limit position is 10 mm or more.

13. The separable bed according to claim 1, wherein a state where the second seat portion is supported by the first guide portion is a combined state of the separation portion and the bed portion, a state where the second seat portion is supported by the second guide portion is a separated state of the separation portion and the bed portion, and the combined state and the separated state are switched between the first lower limit position and the second lower limit position.

14. The separable bed according to claim 2, wherein a state where the second seat portion is supported by the first guide portion is a combined state of the separation portion and the bed portion, a state where the second seat portion is supported by the second guide portion is a separated state of the separation portion and the bed portion, and the combined state and the separated state are switched between the first lower limit position and the second lower limit position.

15. The separable bed according to claim 13, wherein the second seat portion is supported by rising of the first guide portion by the lifter.

16. The separable bed according to claim 14, wherein the second seat portion is supported by rising of the first guide portion by the lifter.

17. The separable bed according to claim 1, wherein the controller controls the lifting operation of the lifter so as to raise the first bed bottom portion above the first lower limit position, in a case where there is a combining instruction of the separation portion and the bed.

18. The separable bed according to claim 2, wherein the controller controls the lifting operation of the lifter so as to raise the first bed bottom portion above the first lower limit position, in a case where there is a combining instruction of the separation portion and the bed.

* * * * *